US007470306B2

(12) United States Patent
Inazawa et al.

(10) Patent No.: US 7,470,306 B2
(45) Date of Patent: Dec. 30, 2008

(54) METHOD FOR PRODUCING FINE METAL POWDER

(75) Inventors: Shinji Inazawa, Osaka (JP); Masatoshi Majima, Osaka (JP); Keiji Koyama, Osaka (JP); Yoshie Tani, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 490 days.

(21) Appl. No.: 10/517,821

(22) PCT Filed: Jun. 11, 2003

(86) PCT No.: PCT/JP03/07392

§ 371 (c)(1),
(2), (4) Date: Dec. 14, 2004

(87) PCT Pub. No.: WO03/106083

PCT Pub. Date: Dec. 24, 2003

(65) Prior Publication Data

US 2005/0217425 A1 Oct. 6, 2005

(30) Foreign Application Priority Data

Jun. 14, 2002 (JP) ..... 2002-174563

(51) Int. Cl.
*B22F 9/24* (2006.01)

(52) U.S. Cl. ..... 75/345

(58) Field of Classification Search ..... 75/345; 205/367

See application file for complete search history.

(56) References Cited

U.S. PATENT DOCUMENTS 5,409,581 A * 4/1995 Harrison et al. ..... 205/334

(Continued)

FOREIGN PATENT DOCUMENTS

DE 3300 865 A1 7/1983

(Continued)

OTHER PUBLICATIONS

English traslation for abstract of DE3300865.*

(Continued)

*Primary Examiner*—Roy King
*Assistant Examiner*—Jie Yang
(74) *Attorney, Agent, or Firm*—McDermott Will & Emery LLP

(57) ABSTRACT

An object of the present invention is to provide a new method for producing a fine metal powder, in which high purity fine metal powders which are more minute than ever before, are uniform in particle diameter, and contain no impurities can be produced at lower cost, in larger amounts, and in safety, characterized by subjecting a solution containing tetravalent titanium ions and having a pH of not more than 7 to cathode electrolytic treatment to reduce parts of the tetravalent titanium ions to trivalent titanium ions, to prepare a reducing agent solution containing both the trivalent titanium ions and the tetravalent titanium ions, and adding a water-soluble compound of at least one type of metal element forming the fine metal powder to the reducing agent solution, followed by mixing, to reduce and deposit ions of the metal element by the reducing action at the time of oxidation of the trivalent titanium ions to the tetravalent titanium ions, to produce the fine metal powder.

6 Claims, 1 Drawing Sheet

U.S. PATENT DOCUMENTS

| | | | |
|---|---|---|---|
| 5,435,830 | A | 7/1995 | Senda et al. |
| 6,540,811 | B2 | 4/2003 | Hosoe et al. |

FOREIGN PATENT DOCUMENTS

| | | | |
|---|---|---|---|
| EP | 1 120 181 | A1 | 8/2001 |
| JP | 4-88104 | A | 3/1992 |
| JP | 5-78716 | A | 3/1993 |
| JP | 11-80816 | A | 3/1999 |
| JP | 11-302709 | A | 11/1999 |
| JP | 3018655 | B2 | 1/2000 |
| JP | 2001-200305 | A | 7/2001 |

OTHER PUBLICATIONS

English translation of DE 3300865.*

* cited by examiner

METHOD FOR PRODUCING FINE METAL POWDER

TECHNICAL FIELD

The present invention relates to a method for producing a significantly minute fine metal powder.

BACKGROUND ART

In recent years, a minute fine metal powder having a particle diameter on the sub-micron order composed of various types of metals or alloys has been utilized or considered to be utilized for:

- a capacitor, an anisotropic conductive film, a conductive paste, a conductive sheet, and so on by making use of characteristics as a conductive material of the metal or the alloy itself and minuteness of the powder,
- a growth catalyst of a carbon nanotube, a reaction catalyst of a gas chemical material, and so on by making use of characteristics as a catalyst material and minuteness, and
- an electromagnetic wave shielding material by making use of characteristics as a magnetic material and minuteness.

As a method of producing such a minute fine metal powder, various producing methods such as a gas phase method for depositing a fine metal powder and making the deposited fine metal powder grow in a gas phase or a liquid phase method for depositing a fine metal powder and making the deposited fine metal powder grow in a solution have been proposed.

For example, Japanese Laid Opened Patent Application No. 11-80816 (1999) discloses a method of producing a fine nickel powder by reducing vapors of nickel chloride within an atmosphere containing sulfur as an example of a producing method by a gas phase method.

As a method of producing a fine metal powder by a gas phase method, a so-called chemical vapor deposition (CVD) method or the like has been generally performed.

On the other hand, Japanese Laid Opened Patent Application No. 11-302709 (1999) discloses a method of producing a fine powder of nickel or its alloy by dropping a solution containing at least nickel ions in a reducing agent solution containing hydrazine, alkali hypophosphite, or alkali borohydride as a reducing agent, to reduce and deposit the nickel ions or the like.

However, sulfur having a concentration of approximately 500 to 2000 ppm is generally contained in a fine metal powder produced by the method disclosed in Japanese Laid Opened Patent Application No. 11-80816 (1999) out of the foregoing methods. Therefore, the purity of the fine metal powder is reduced and correspondingly, characteristics such as conductivity are degraded.

Furthermore, all of conventional gas phase methods, including the producing method disclosed in the above-mentioned gazettes and the CVD method, have the disadvantage that the initial cost and the running cost of a producing apparatus employed for the implementation are significantly high.

Moreover, in the gas phase method, the growth speed of a metal is low. Further, it is difficult to produce fine metal powders in large amounts at one time because the above-mentioned producing apparatus is of a batch type.

Furthermore, in the gas phase method, the growth speed of a metal is low, so that a reaction time period must be made long. Therefore, fine metal powders which are deposited in the early stages of reaction and start to grow and fine metal powders which are deposited later and start to grow greatly differ in particle diameter at the time when the reaction is terminated. Accordingly, the particle diameter distribution of the produced fine metal powders tends to be broad. When an attempt to obtain fine metal powders which are uniform in particle diameter is made, therefore, the fine metal powders whose particle diameters are too large and the fine metal powders whose particle diameters are too small must be removed in large amounts, resulting in significantly reduced yield.

Therefore, the production cost of the fine metal powders produced by the gas phase method are significantly high. In the present circumstances, therefore, the applications thereof are limited.

On the other hand, the liquid phase method can be implemented if there is at least an apparatus for agitating a solution. Therefore, the initial cost and the running cost of the producing apparatus can be made significantly lower, as compared with those in the gas phase method.

In the liquid phase method, the growth speed of a metal is higher than that in the gas phase method. Moreover, it is also easier to increase the size of the apparatus. Therefore, the metal powders can be mass-produced at one time even by a batch-type producing apparatus. Further, fine metal powders can be further mass-produced by employing a continuous-type producing apparatus.

Moreover, a larger number of fine metal powders can be deposited and made to grow uniformly almost simultaneously by making a reaction time period short because the growth speed is high. Therefore, fine metal powders whose particle diameter distribution is sharp and whose particle diameters are uniform can be produced with a high yield.

Out of the above-mentioned methods disclosed in the above-mentioned Japanese Laid Opened Patent Application No. 11-302709 (1999), the method of using alkali hypophosphite or alkali borohydride as a reducing agent has the disadvantage that the purity of fine metal powders to be produced is reduced and correspondingly, characteristics such as conductivity are degraded because phosphorous or boron is deposited together with a metal.

On the other hand, when hydrazine or a hydrazine-based compound is used as a reducing agent, no deposition together with a metal is produced. However, the compound is a hazardous material. Therefore, strict safety management is required for handling.

Therefore, Japanese Patent Application No. 3018655 discloses a producing method using titanium trichloride as a method of producing fine metal powders by a liquid phase method using a new reducing agent which does not have these problems.

That is, in a state where a water-soluble compound of a metal element, together with a complexing agent, as required is dissolved in water to produce a solution, ammonia water or the like is then added as a pH adjuster to the solution to adjust the pH of the solution to not less than 9, titanium trichloride is added as a reducing agent, to reduce and deposit ions of the metal element utilizing the reducing action in a case where trivalent titanium ions are oxidized, thereby producing fine metal powders.

In the above-mentioned gazette, it is advocated that high purity fine metal powders containing no impurities can be produced in safety by such a producing method.

When the inventors have examined the above-mentioned producing method, it has been made clear that the method has the following problems.

(1) In the above-mentioned producing method, fine metal powders having an average particle diameter of approximately 400 nm to 1 μm can be produced. However, minute fine metal powders having a smaller average particle diameter of not more than 400 nm cannot be produced in what way reaction conditions are adjusted.

(2) In a case where titanium trichloride is added to a solution having a pH of not less than 9 in a state where the concentration thereof is 100%, which is not disclosed in the above-mentioned gazette, approximately the whole amount of the added titanium trichloride rapidly reacts with water, to be deposited or precipitated in the solution as titanium oxide by hydrolysis. Even if titanium trichloride is added in the state of a stable hydrochloric acid solution, approximately 20% of the added titanium trichloride reacts with water, to be deposited or precipitated as titanium oxide by hydrolysis. Although in the above-mentioned gazette, it is considered that titanium trichloride is used up at one time, titanium trichloride is difficult to preserve and handle. Moreover, it is high in cost. Therefore, a case where the production cost by the above-mentioned producing method in which titanium trichloride is used up at one time is higher than the unit cost of the fine metal powder to be produced, for example. Therefore, the producing method disclosed in the above-mentioned gazette is not suitable for industrial production of fine metal powders, although a certain degree of results are obtained at a laboratory level.

DISCLOSURE OF INVENTION

An object of the present invention is to provide a new method for producing a fine metal powder, in which high purity fine metal powders which are more minute than ever before, are uniform in particle diameter, and contain no impurities can be produced at lower cost, in larger amounts, and in safety.

In order to attain such an object, a method for producing a fine metal powder according to the present invention is characterized by comprising the steps of subjecting a solution containing tetravalent titanium ions and having a pH of not more than 7 to cathode electrolytic treatment to reduce parts of the tetravalent titanium ions to trivalent titanium ions, to obtain a reducing agent solution containing both the trivalent titanium ions and the tetravalent titanium ions, and adding a water-soluble compound of at least one type of metal element forming the fine metal powder to the reducing agent solution, followed by mixing, to reduce and deposit ions of the metal element by the reducing action at the time of oxidation of the trivalent titanium ions to the tetravalent titanium ions, to obtain the fine metal powder.

The trivalent titanium ions have the function of reducing and depositing ions of the metal element to make the fine metal powder grow when the titanium ions themselves are oxidized, as described above. On the other hand, the tetravalent titanium ions have the function of restraining the growth of the fine metal powder according to the examination of the inventors.

In the reducing agent solution containing both the trivalent titanium ions and the tetravalent titanium ions, both the trivalent and tetravalent titanium ions cannot completely independently exist. A plurality of trivalent ions and a plurality of tetravalent ions compose a cluster, to exist in a hydrated and complexed state as a whole.

Therefore, the fine metal powder is formed while exerting the function of reducing and depositing the ions of the metal element by the trivalent titanium ions to make the fine metal powder grow and the function of restraining the growth of the fine metal powder by the tetravalent titanium ions on the same fine metal powder in one cluster.

In the producing method according to the present invention, it is possible to produce minute fine metal powders having smaller particle diameters and having an average particle diameter of not more than 400 nm, as compared with those in the conventional liquid phase method using the reducing agent having only the function of making fine metal powders grow or the producing method disclosed in Japanese Patent Application No. 3018655 having only the function of making fine metal powders grow by using up titanium trichloride at one time.

Moreover, in the producing method according to the present invention, the strength or weakness of the conflicting functions by both trivalent and tetravalent titanium ions in the cluster, described above, can be adjusted by changing the existence ratio of the trivalent titanium ions and the tetravalent titanium ions in the reducing agent solution at the time when reaction is started, thereby making it possible to arbitrarily control the average particle diameter of the fine metal powders to be produced.

In the producing method according to the present invention, a larger number of fine metal powders can be almost simultaneously deposited and made to grow by making a reaction time period short because the growth speed in the liquid phase method is higher than that in the gas phase method. Therefore, fine metal powders whose particle diameter distribution is sharp and whose particle diameters are uniform can be produced with a high yield.

Moreover, the tendency of ionization of the titanium ions is significantly great, so that the titanium ions are hardly deposited as a titanium metal in reducing and depositing the ions of the metal element.

Therefore, the produced fine metal powder substantially contains no titanium (even if it contains titanium, the content thereof is not more than 100 ppm). Accordingly, the fine metal powder has a high purity, and is superior in properties such as conductivity.

Therefore, the total amount of the titanium ions existing in the solution is hardly changed. When the fine metal powder is deposited by the above-mentioned reaction, almost all of the titanium ions are only oxidized to tetravalent titanium ions. When the solution after the reaction is subjected to the cathode electrolytic treatment, to reduce parts of the tetravalent titanium ions to the trivalent titanium ions, therefore, the solution can be reproduced as a reducing agent solution even many times, and can be repeatedly employed for producing the fine metal powder.

At the time of the initial reaction, the solution containing the tetravalent titanium ions must be produced. However, titanium tetrachloride which is its main raw material is industrially more versatile than titanium trichloride used in the producing methods disclosed in the above-mentioned gazettes, so that it is easily available and is significantly low in cost.

A solution containing tetravalent titanium ions which is produced at the time of the initial reaction or recovered after the previous reaction is stable because it is used for the subsequent cathode electrolytic treatment and the deposition of the fine metal powder in a state where the pH thereof is not more than 7. That is, the pH of the solution varies at the time of the subsequent cathode electrolytic treatment and deposition of the fine metal powder. If the pH of the solution containing the tetravalent titanium ions which is a starting material is not more than 7, as described above, however, the fine metal powder can be produced without producing titanium oxide by hydrolysis throughout all the steps of the production.

Moreover, in subjecting the solution containing the tetravalent titanium ions to the cathode electrolytic treatment to obtain the reducing agent solution, the existence ratio of the trivalent titanium ions and the tetravalent titanium ions can be simply adjusted, as described above, by controlling the conditions of the electrolytic treatment.

In the producing method according to the present invention, therefore, high purity fine metal powders which are more minute than ever before, are uniform in particle diameter, and contain no impurities can be produced at lower cost, in larger amounts, and in safety.

It is preferable that as the solution containing the tetravalent titanium ions forming the reducing agent solution, a solution containing chlorine ions having a molar ratio which is not less than four times that of the ions is used.

The tetravalent titanium ions react with hydroxide ions ($OH^-$) so that $TiO^{2+}$ ions are easily produced in water containing fewer chlorine ions than those in the above-mentioned range. Moreover, the ions are stable. In almost all of cases, even if the cathode electrolytic treatment is performed, therefore, reduction reaction of the tetravalent titanium ions in the above-mentioned $TiO^{2+}$ ions to trivalent titanium ions does not progress, so that approximately the whole current-carrying amount is consumed for reducing hydrogen ions to only produce hydrogen gas.

On the other hand, in a solution containing chlorine ions at a molar ratio which is four or more times that of titanium ions, parts of $TiO^{2+}$ ions are replaced with chlorine, to form a titanium chloride complex [TiClx (x is 1~4)]. Since tetravalent titanium ions in the titanium chloride complex are in a relatively free state, they can be reduced to trivalent titanium ions more simply and efficiently by the cathode electrolytic treatment.

It is preferable that as such an solution, a stable hydrochloric acid solution of titanium tetrachloride which is easily available and is significantly low in cost, as described above, is used.

Examples of the metal element which can be deposited by the reducing action at the time of oxidation of the trivalent titanium ions to the tetravalent titanium ions include Ag, Au, Bi, Co, Cu, Fe, In, Ir, Mn, Mo, Ni, Pb, Pd, Pt, Re, Rh, Sn and Zn. If one type of the metal elements is used, a fine metal powder composed of only the metal element can be produced. If at least two types of metal elements are used, a fine metal powder composed of an alloy of the metals can be produced.

In the producing method according to the present invention, significantly minute fine metal powders having an average particle diameter of not more than 400 nm, as described above, which could not be so far produced, can be produced.

The solution containing the tetravalent titanium ions after the deposition of the fine metal powder is reproduced as the reducing agent solution by the cathode electrolytic treatment, as described above, and can be repeatedly used for producing the fine metal powder. This allows the production cost of the fine metal powder to be significantly reduced.

BEST MODE FOR CARRYING OUT THE INVENTION

Figure 1:
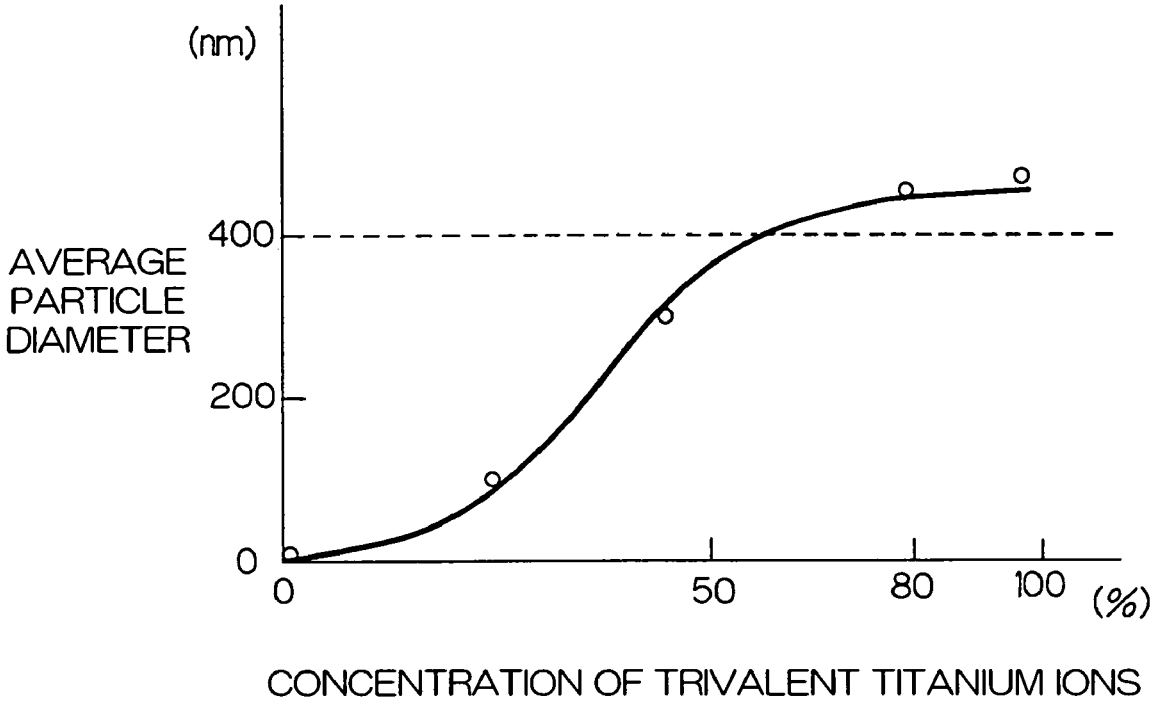
FIG. 1 is a graph showing the effect of the ion concentration of trivalent titanium ions on the average particle diameter of fine metal powders in depositing the fine metal powders by reducing ions of a metal element using a reducing agent solution containing trivalent titanium ions and tetravalent titanium ions.

The present invention will be described in detail below.

A method for producing a fine metal powder according to the present invention comprises the steps of (I) subjecting a solution containing tetravalent titanium ions and having a pH of not more than 7 to cathode electrolytic treatment to reduce parts of the tetravalent titanium ions to trivalent titanium ions, to obtain a reducing agent solution containing both the trivalent titanium ions and the tetravalent titanium ions, and (II) adding a water-soluble compound of at least one type of metal element forming the fine metal powder to the reducing agent solution, followed by mixing, to reduce and deposit ions of the metal element by the reducing action at the time of oxidation of the trivalent titanium ions to the tetravalent titanium ions, to obtain the fine metal powder.

As the solution containing the tetravalent titanium ions and having a pH adjusted to a predetermined value of not more than 7, which is prepared in the step (I) out of the foregoing steps, at least one of a solution produced at the time of initial reaction and a solution recovered after the previous reaction is used.

An example of the former solution produced at the time of initial reaction is a stable hydrochloric acid solution of titanium tetrachloride. Such a solution may be used as it is for the cathode electrolytic treatment which is the subsequent step because the pH thereof is naturally not more than 7, or may be used for the cathode electrolytic treatment after the pH thereof is further adjusted.

The latter solution recovered after the previous reaction (which is the remainder of a mixed solution which is a mixture of ions of a metal element and a reducing agent solution and therefore, is referred to as a "residual mixed solution") may be used, if the pH thereof is a predetermined value of not more than 7, as it is for the cathode electrolytic treatment which is the subsequent step, or may be used for the cathode electrolytic treatment after the pH thereof is further adjusted. The solution may be used, if the pH thereof exceeds 7, for the cathode electrolytic treatment after the pH is adjusted to the predetermined value of not more than 7.

Particularly when the production of the fine metal powder is continuously repeated, it is desirable in keeping the subsequent reaction conditions constant that the pH of the solution in the initial reaction and the pHs of the residual mixed solutions in the second and subsequent reactions are adjusted to the predetermined value of not more than 7 in the case of the cathode electrolytic treatment.

In order to reduce the pH of the solution or the residual mixed solution, an acid may be simply added thereto. Considering that chlorine ions are supplied, as described below, or the effect of storage of ions in the solution is made as small as possible, however, it is preferable that hydrochloric acid having the same anion as that of titanium tetrachloride and having a simple structure is used as the above-mentioned acid.

On the other hand, in order to raise the pH of the solution or the residual mixed solution, it is still easy to directly put an alkali. Considering that the effect of storage of ions in the solution is made as small as possible, however, it is preferable that a two-cell type electrolytic cell divided by an anion exchange membrane, for example, is left at rest with the solution or the residual mixed solution poured into one of cells in the electrolytic cell and an alkali such as a sodium hydroxide solution poured into the other cell, to raise the pH by diffusion of hydroxide ions.

In the present invention, the solution produced at the time of the initial reaction and the residual mixed solution recovered after the previous reaction may be simultaneously used. Examples of a scene requiring simultaneous use include cases such as a case where the residual mixed solution lost in amount at the time of filtering the fine metal powder, for example, is replenished with a new solution.

It is preferable that both the solution produced at the time of the initial reaction and the residual mixed solution recovered after the previous reaction include chorine ions having a molar ratio which is four or more times that of the tetravalent titanium ions, as previously described.

When titanium tetrachloride is used as a starting material to produce a solution, as described above, at the time of the initial reaction, the solution already has contained chlorine ions having a molar ratio which is four times that of titanium ions which are derived from the titanium tetrachloride. Since the solution of the titanium tetrachloride is made hydrochloric acidic such that it should be stabilized, as described above, the solution also contains chlorine ions which are derived from such a hydrochloric acid, so that the amount of the chlorine ions relative to the amount of the titanium ions is sufficient.

When the hydrochloric acid solution of titanium tetrachloride is used as the initial solution, therefore, a reducing agent solution containing both trivalent titanium ions and tetravalent titanium ions can be produced simply and efficiently by the cathode electrolytic treatment.

At the time of the cathode electrolytic treatment, however, the chlorine ions are moved toward an anode, to go out of the solution as chlorine gas after being deprived of electrons by the anode. When the cathode electrolytic treatment is repeated, the amount of the chlorine ions tends to be gradually reduced.

Therefore, it is preferable that chlorine ions are supplied as required particularly to the residual mixed solution recovered after the previous reaction in order to maintain the residual mixed solution such that the molar ratio of the chlorine ions is not four or less times that of the titanium ions.

In order to supply chlorine ions, a water-soluble compound containing chlorine ions may be separately added to the solution. However, it is preferable that a hydrochloric acid is used as an acid for reducing the pH of the solution, as previously described, or chloride is used as a water-soluble compound of a metal element to be deposited, to supply chlorine ions simultaneously with replenishment of the compound, as described later.

This makes it possible to save time and labor to separately prepare a water-soluble compound containing chlorine ions and add the water-soluble compound to the solution as required and to always maintain the molar ratio of the chlorine ions in the solution at a molar ratio which is four or more times that of the tetravalent titanium ions.

When the molar ratio of the chlorine ions is just four times the molar ratio of the tetravalent titanium ions, cathode efficiency indicating what degree of the current-carrying amount at the time of the cathode electrolytic treatment is utilized for reducing the tetravalent titanium ions to trivalent titanium ions is several percents. If the cathode efficiency is remarkably raised to 60% if the molar ratio of the chlorine ions is set to six times that of the tetravalent titanium ions, and raised to 95% if the molar ratio of the chlorine ions is set to eight times that of the tetravalent titanium ions.

That is, the larger the molar ratio of the chlorine ions is, the higher the cathode efficiency becomes. Even if the molar ratio of the chlorine ions exceeds 10 times the molar ratio of the tetravalent titanium ions, however, a more effect of addition cannot be obtained. Not only that, excessive chlorine ions may affect reaction.

It is more preferable that both the molar ratio of the chlorine ions contained in the solution produced at the time of the initial reaction or the residual mixed solution recovered after the previous reaction is four to ten times the molar ratio of the tetravalent titanium ions.

In the present invention, the solution or the residual mixed solution is then subjected to the cathode electrolytic treatment to reduce parts of the trivalent titanium ions to the trivalent titanium ions, thereby obtaining the reducing agent solution containing both the trivalent titanium ions and the tetravalent titanium ions.

As a specific method, a two-cell type electrolytic cell divided by a anion exchange membrane, which is the same as that employed at the time of adjusting the pH, for example, is prepared.

The solution or the residual mixed solution is then poured into one of the cells in the electrolytic cell, and a sodium sulfate solution or the like is poured into the other cell. A DC current is caused to flow with the side of the solution or the residual mixed solution containing the tetravalent titanium ions used as a cathode and the side of the sodium sulfate solution used as an anode in a state where electrodes are dipped into both the solutions.

Consequently, parts of the tetravalent titanium ions are reduced to trivalent titanium ions, thereby producing a reducing agent solution containing both the trivalent titanium ions and the tetravalent titanium ions.

When the existence ratio of the trivalent titanium ions and the tetravalent titanium ions to the reducing agent solution is adjusted, as previously described, the average particle diameter of fine metal powders to be produced can be arbitrarily controlled, as shown in FIG. 1, for example.

In FIG. 1, the horizontal axis represents the concentration (%) which trivalent titanium ions occupy in the total amount of trivalent and tetravalent titanium ions in a reducing agent solution at the time when reaction is started, and the vertical axis represents the average particle diameter (nm) of fine metal powders to be produced.

When the concentration of the trivalent titanium ions is 100%, that is, no tetravalent titanium ions exist in the reducing agent solution, the average particle diameter of the fine metal powders to be formed exceeds 400 nm. As the concentration of the trivalent titanium ions is reduced and correspondingly, the concentration of the tetravalent titanium ions is increased, however, the average particle diameter of the fine metal powders is gradually reduced. When the concentration of the trivalent titanium ions is 0%, that is, no trivalent titanium ions exists and the tetravalent titanium ions occupying the total amount of the reducing agent solution, reduction reaction does not progress. This indicates that no fine metal powders are formed, that is, the average particle diameter is 0 nm.

FIG. 1 is only one example. It is clear from the results of examples, described later, that the relationship between the concentration of the trivalent titanium ions and the average particle diameter of the fine metal powders is not limited to one shown in FIG. 1.

In an example 1, for example, when the concentration of trivalent titanium ions is 60%, the average particle diameter of fine nickel powders is 260 nm. In an example 2, when the concentration of trivalent titanium ions is 30%, the average particle diameter of fine nickel powders is 150 nm. In either case, the particle diameter is shifted toward the smaller particle diameter from that shown in FIG. 1. It is also found from the results of the example 1 and the examples 3 to 5 that even if the concentration of trivalent titanium ions is fixed to 60%, the particle diameter of the fine metal powder differs depending on a metal element to be deposited.

In order to adjust the existence ratio of the trivalent titanium ions and the tetravalent titanium ions in the reducing agent solution, the conditions of the cathode electrolytic treatment, such as the pH of the solution and a time period for electrolytic treatment, may be controlled. For example, the longer a time period for the cathode electrolytic treatment is made, the higher the existence ratio of the trivalent titanium ions can be made.

The procedure then proceeds to the step in the foregoing item (II). In the step, a water-soluble compound of at least one type of metal element forming the fine metal powder is added to the reducing agent solution produced in the foregoing manner, followed by mixing.

Examples of the metal element include one type or two or more types of Ag, Au, Bi, Co, Cu, Fe, In, Ir, Mn, Mo, Ni, Pb, Pd, Pt, Re, Rh, Sn and Zn, as described above.

Examples of the water-soluble compound of the metal elements include various types of water-soluble compounds such as a sulfate compound and chloride. Considering that in continuously and repeatedly producing the fine metal powder, chlorine ions are also simultaneously supplied, as previously described, or the effect of storage of ions in the solution is made as small as possible and further in consideration of the magnitude of solubility in water, however, chloride is preferable as the water-soluble compound.

The water-soluble compound of the metal element may be directly put into the reducing agent solution. In the case, however, reaction first locally progresses around the put compound. Consequently, particle diameters of fine metal powders may be made non-uniform, and the particle diameter distribution thereof may be broadened.

Therefore, it is preferable that the water-soluble compound of the metal element is added to the reducing agent solution in the state of a solution which is diluted by being dissolved in water (hereinafter referred to as a "reaction solution").

A complexing agent may be blended as required with the reaction solution to be initially added.

Usable as the completing agent are various types of complexing agents conventionally known.

In order to produce fine metal powders whose particle diameters are as small as possible and whose particle diameter distribution is as sharp as possible, it is critically important to increase the size of a core of the fine metal powder to be produced in a solution to make a time period for the subsequent reduction reaction as short as possible in reducing and depositing ions of the metal element by the oxidization of trivalent titanium ions. In order to realize this, it is effective to control both the oxidation reaction speed of the trivalent titanium ions and the reduction reaction speed of the ions of the metal element. For this purpose, it is desirable that both the trivalent titanium ions and the ions of the metal element are complexed.

Examples of the complexing agent having such a function include at least one type selected from a group consisting of trisodium citrate [$Na_3C_6H_5O_7$], sodium tartrate [$Na_2C_4H_4O_6$], sodium acetate [$NaCH_3CO_2$], gluconic acid [$C_6H_{12}O_7$], sodium thiosulfate [$Na_2S_2O_3$], ammonia [$NH_3$], and ethylendiaminetetraacetic acid [$C_{10}H_{16}N_2O_8$].

In continuously and repeatedly producing the fine metal powder, it is preferable that in order to replenish the consumed ions of the metal element, a part of the residual mixed solution recovered after the previous reaction is batched off in significantly small amounts before the cathode electrolytic treatment, the water-soluble compound of the metal element corresponding to the ions to be replenished is dissolved in the residual mixed solution to produce a replenished reaction solution, and the replenished reaction solution is added to the reducing agent solution reproduced by the cathode electrolytic treatment. This allows the concentration of the mixed solution to be kept constant. In this case, the complexing agent is not consumed. The complexing agent initially added exists in the solution, so that the complexing agent need not be replenished.

It is preferable that particularly at the time of the initial reaction, the pH of the reducing agent solution is adjusted in a predetermined range.

The timing at which the pH of the reducing agent solution is adjusted may be previous to or subsequent to adding the reaction solution to the reducing agent solution in order to adjust the pH of the reducing agent solution, a sodium carbonate solution, an ammonia solution, or a sodium hydroxide solution, for example, may be added as a pH adjuster. When the pH of the reducing agent solution is within a predetermined range from the beginning, however, the adjustment of the pH can be omitted.

At the time of the second and subsequent reactions, the adjustment of the pH can be omitted because the range in which the pH of the reducing agent solution is initially adjusted is maintained in a normal case. Accordingly, in the second and subsequent reactions, it is desirable that only when the pH departs from a predetermined range, the pH is adjusted by adding a pH adjuster, also in consideration of prevention of the change in the composition of the solution.

The pH of the reducing agent solution affects the deposition speed of a metal and therefore, affects the shape of a fine metal powder to be deposited.

For example, the higher the pH of the reducing agent solution is, the higher the deposition speed of the metal becomes. Therefore, significantly minute fine metal powders are produced in large amounts in the solution in the early stages of reaction. In the step of the growth of the fine metal powder, a large number of fine metal powders are easily coupled to have a shape such as a cluster shape or a chain shape.

Particularly in the case of a metal having ferromagnetism such as nickel or its alloy, significantly minute fine metal powders produced in large amounts have a single crystal structure in the early stages of reaction and therefore, are simply polarized into a bipolar phase to easily enter a state where a large number of metal powders are connected to one another in a chain shape. Moreover, when the reaction progresses, the metal or its alloy is further deposited thereon to fix the chain-shaped structure. Accordingly, the fine metal powders having ferromagnetism are brought into a chain shape.

On the other hand, the lower the pH of the reducing agent solution is, the lower the deposition speed of the metal becomes. As the particle diameter of the fine metal powder produced in the solution in the early stages of reaction increases, and the number of fine metal powders decreases. Therefore, the growth thereof tends to uniformly progress on surfaces of the fine metal powders. Consequently, the shape of the fine metal powder is brought near a spherical shape.

Therefore, it is desirable to adjust the pH of the reducing agent solution in a range suitable therefore depending on what shape (a chain shape, a cluster shape, or a spherical shape) the fine metal powder has.

EXAMPLES

The present invention will be described in more detail on the basis of examples and comparative examples.

Example 1

Production of Fine Nickel Powder

[Initial Preparation of Reducing Agent Solution]

A 20% hydrochloric acid solution of titanium tetrachloride was prepared. The amount of the titanium tetrachloride was set such that when a reducing agent solution obtained by subjecting the solution to cathode electrolytic treatment in the subsequent step was mixed with a reaction solution, described in the following item, at a predetermined ratio, and a pH adjuster or ion exchanged water, as required, was added to produce a predetermined amount of mixed solution, the molar ratio of the sum of trivalent and tetravalent titanium ions to the total amount of the mixed solution would be 0.2 M (mole/litter). The pH of the solution was 4.

The solution was then poured into one of cells in a two-cell type electrolytic cell divided by an anion exchange membrane produced by Asahi Glass Co., Ltd. Further, a sodium sulfate solution having a molar ratio of 0.1 M was poured into the other cell.

A reducing agent solution was prepared by dipping carbon felt electrodes in the solution, and carrying a 3.5 V DC current under constant-voltage control between the electrodes, the electrode dipped in the solution of titanium tetrachloride used as a cathode and the electrode dipped in the sodium sulfate solution used as an anode.

By the cathode electrolytic treatment, 60% of the tetravalent titanium ions in the reducing agent solution were reduced to trivalent titanium ions, so that the pH of the solution became 1.

[Production of Reaction Solution]

Nickel chloride and trisodium citrate were dissolved in ion exchanged water, to produce a reaction solution. The amount of the nickel chloride was set such that the molar ratio thereof to the total amount of the mixed solution would be still 0.16 M.

The amount of the trisodium citrate was adjusted such that the molar ratio thereof to the total amount of the mixed solution would be 0.3 M.

[Production of Fine Nickel Powder (First Time)]

The reducing agent solution was poured into a reaction cell, and was agitated while maintaining the liquid temperature thereof at 50° C., a saturated solution of sodium carbonate serving as a pH adjuster was added to the solution to adjust the pH of the solution to 5.2, the reaction solution was gradually added to the solution, and ion exchanged water was further added thereto as required, to produce a predetermined amount of mixed solution. The reaction solution and the ion exchanged water, which have been previously warmed to 50° C., were added.

When the mixed solution continued to be agitated for several minutes while maintaining the liquid temperature thereof at 50° C., sediments were deposited. Accordingly, the agitation was stopped, to immediately filter, rinse, and dry the sediments, to obtain fine powders. The pH of the mixed solution at the time point where the reaction was terminated was 4.0. Almost all of the titanium ions in the mixed solution were tetravalent.

When the composition of the obtained fine powder was measured by ICP (Inductivity Coupled Plasma) emission spectrometry, it was confirmed that the composition was nickel having a purity of 99.94%.

The appearance of the fine nickel powder was photographed using a scanning-type electron microscope. When the particle diameters of all the fine nickel powders whose actual sizes fall within a rectangular shape area of 1.8 μm×2.4 μm of the photograph were measured and averaged, the average was 260 nm.

From the results of the above-mentioned measurement of the particle diameters, an accumulation curve representing the relationship between the particle diameters of the fine nickel powders and the accumulation percentage of frequency was found. When a particle diameter difference $G_1$ between the particle diameter $d_{10}$ of fine nickel powders having a 10% particle diameter and the particle diameter $d_{50}$ of fine nickel powders having a 50% particle diameter was found by the following equation (1) from the accumulation curve, it was 53.6%:

$$G_1(\%)=(d_{50}-d_{10})/d_{50}\times 100 \quad (1)$$

Similarly, when a particle diameter difference $G_2$ between the particle diameter $d_{90}$ of fine nickel powders having a 90% particle diameter and the particle diameter $d_{50}$ of fine nickel powders having a 50% particle diameter was found by the following equation (2), it was 116.8%:

$$G_2(\%)=(d_{90}-d_{50})/d_{50}\times 100 \quad (2)$$

From the results, it was confirmed that the particle diameters of the fine nickel powders initially produced were significantly small, the particle diameter distribution thereof was sharp, and the particle diameters thereof are uniform.

[Reproduction of Reducing Agent Solution]

Only a part of the residual mixed solution after the filtering of the fine nickel powder was gradually added to powdered nickel chloride, to produce a replenished reaction solution of nickel. The amount of the nickel chloride was set such that when the replenished reaction solution was added to a reducing agent solution reproduced by subjecting the remainder of the residual mixed solution to cathode electrolytic treatment in the subsequent step to produce a predetermined amount of new mixed solution, the molar ratio thereof to the total amount of the new mixed solution would be 0.16 M.

Further, the total amount of the remainder of the residual mixed solution was poured into one of cells in the same two-cell type electrolytic cell as the foregoing one, and a sodium sulfate solution having a molar ratio of 0.1 M was poured into the other cell.

Carbon felt electrodes were dipped into the residual mixed solution and the sodium sulfate solution, and a 3.5 V DC current was carried under constant-voltage control between the electrodes, the electrode dipped in the residual mixed solution used as a cathode and the electrode dipped in the sodium sulfate solution used as an anode, to subject the solutions to cathode electrolytic treatment.

The cathode electrolytic treatment was performed such that 60% of tetravalent titanium ions in the total amount of the residual mixed solution were reduced to trivalent titanium ions, thereby reproducing the remainder of the residual mixed solution as a reducing agent solution. Further, in the cathode, the electrolysis of water progressed in parallel therewith. Accordingly, hydrogen ions were consumed, so that the pH of the reproduced reducing agent solution became 7.

The pH of the residual mixed solution used for reproducing the reducing agent solution and producing the replenished reaction solution of nickel was adjusted to 4.0. That is, when the pH of the mixed solution at the time when the previous reaction was terminated was 4.0, as described above, the residual mixed solution after recovery of the fine metal powder was employed as it was. When the pH was larger than 4.0, however, a hydrochloric acid solution was added to the residual mixed solution, to adjust the pH to 4.0. Further, when the pH was smaller than 4.0, the residual mixed solution was poured into one of the cells in the above-mentioned two-cell type electrolytic cell, and a sodium sulfate solution having a molar ratio of 0.1 M was put into the other cell, and the residual mixed solution was left at rest, to adjust the pH to 4.0 by diffusion of hydroxide ions.

[Production of Fine Nickel Powder (Second Time)]

The reducing agent solution reproduced in the foregoing manner was poured into a reaction cell, and was agitated while maintaining the liquid temperature thereof at 50° C., and the above-mentioned replenished reaction solution was added thereto, to produce a predetermined amount of new mixed solution. The pH thereof was 5 to 6. The replenished reaction solution, which has been previously warmed to 50° C., was added.

When the mixed solution continued to be agitated for several minutes while maintaining the liquid temperature thereof at 50° C., sediments were deposited. Accordingly, the agitation was stopped, to immediately filter, rinse, and then dry the sediments, to obtain fine powders. The pH of the mixed solution at the time point where the reaction was terminated was 4.0. Almost all of titanium ions in the mixed solution were tetravalent.

When the composition of the obtained fine powder was measured by ICP emission spectrometry, it was confirmed that the composition was nickel having a purity of 99.94%.

When the average particle diameter of the fine nickel powders was measured in the same manner as described above, it was 260 nm.

Furthermore, when particle diameter differences $G_1$ and $G_2$ were found in the foregoing manner from the results of the measurement, they were respectively 80% and 78%.

From these results, it was confirmed that the particle diameters of the fine nickel powders produced second coincided with the particle diameters of the fine nickel powders initially produced, the particle diameter distribution thereof was sharp, and the particle diameters thereof were uniform.

[Production of Fine Nickel Powder (Third and Subsequent Times)]

After the pH of the mixed residual solution after the second production of the fine nickel powders was adjusted to 4.0 as required, the reproduction of the reducing agent solution, the production of the replenished reaction solution of nickel, and the third and subsequent productions of fine nickel powders under the same conditions as those in the second projection using the solutions were repeatedly performed in the same manner as described above.

In either case, fine nickel powders whose average particle diameter was fixed at 260 nm, among which particle diameter differences $G_1$ and $G_2$ fell within a range of 80%, whose particle diameter distribution was sharp, and whose particle diameters were uniform could be continuously produced.

Example 2

Production of Fine Nickel Powder

[Reproduction of Reducing Agent Solution]

In the same manner as that in the example 1, the pH of a residual mixed solution after the first production of fine nickel powders was adjusted to 4.0 as required, and only a part of the residual mixed solution was then gradually added to powdered nickel chloride, to produce a replenished reaction solution of nickel. The amount of the nickel chloride was set such that when the replenished reaction solution was added to a reducing agent solution reproduced by subjecting the remainder of the residual mixed solution to cathode electrolytic treatment in the subsequent step to produce a predetermined amount of new mixed solution, the molar ratio thereof to the total amount of the new mixed solution would be 0.08 M.

Further, the total amount of the remainder of the residual mixed solution was poured into one of the cells in the same two-cell type electrolytic cell as the foregoing one, and a sodium sulfate solution having a molar ratio of 0.1 M was poured into the other cell.

Carbon felt electrodes were dipped into the residual mixed solution and the sodium sulfate solution, and a 3.5 V DC current was carried under constant-voltage control between the electrodes, the electrode dipped in the residual mixed solution used as a cathode and the electrode dipped in the sodium sulfate solution used as an anode, to subject the solutions to cathode electrolytic treatment.

The cathode electrolytic treatment was performed such that 30% of tetravalent titanium ions in the total amount of the residual mixed solution were reduced to trivalent titanium ions, thereby reproducing the remainder of the residual mixed solution as a reducing agent solution. Further, in the cathode, the electrolysis of water progressed in parallel therewith. Accordingly, hydrogen ions were consumed, so that the pH of the reproduced reducing agent solution became 6.2.

[Production of Fine Nickel Powder (Second Time)]

The reducing agent solution reproduced in the foregoing manner was poured into a reaction cell, and was agitated while maintaining the liquid temperature thereof at 50° C., and the above-mentioned replenished reaction solution was added thereto, to produce a predetermined amount of new mixed solution. The pH thereof was 5 to 6. The replenished reaction solution, which has been previously warmed to 50° C., was added.

When the mixed solution continued to be agitated for several minutes while maintaining the liquid temperature thereof at 50° C., sediments were deposited. Accordingly, the agitation was stopped, to immediately filter, rinse, and then dry the sediments, to obtain fine powders. The pH of the mixed solution at the time point where the reaction was terminated was 4.0. Almost all of titanium ions in the mixed solution were tetravalent.

When the composition of the obtained fine powder was measured by ICP emission spectrometry, it was confirmed that the composition was nickel having a purity of 99.9%.

When the average particle diameter of the fine nickel powders was measured in the same manner as described above, it was 150 nm.

Furthermore, when particle diameter differences $G_1$ and $G_2$ were found in the foregoing manner from the results of the measurement, they were respectively 81% and 79%.

From these results, it was confirmed that the particle diameters of the fine nickel powders produced second in the example 2 were so controlled that the average particle diameter thereof was smaller than that of the fine nickel powders initially produced by reducing the existence ratio of trivalent titanium ions in the solution at the time when reaction was started, the particle diameter distribution thereof was sharp, and the particle diameters thereof were uniform.

[Production of Fine Nickel Powder (Third and Subsequent Times)]

After the pH of the mixed residual solution after the second production of the fine nickel powders was adjusted to 4.0 as required, the reproduction of the reducing agent solution, the production of the replenished reaction solution of nickel, and the third and subsequent production of fine nickel powders under the same conditions as those in the second production using the solutions were repeatedly performed in the same manner as described above.

In either case, fine nickel powders whose average particle diameter was fixed to 150 nm, among which particle diameter differences $G_1$ and $G_2$ fell within a range of 70%, whose particle diameter distribution was sharp, and whose particle diameters were uniform could be continuously produced.

Example 3

Production of Fine Copper Powder

[Production of Reducing Agent Solution]

A reducing agent solution having a pH of 1 obtained by reducing 60% of tetravalent titanium ions to trivalent titanium ions, which was the same as that initially prepared in the example 1, was produced.

[Production of Reaction Solution]

Copper chloride, trisodium citrate, and sodium tartrate were dissolved in ion exchanged water, to produce a reaction solution. The amount of the copper chloride was set such that in mixing the reaction solution with the reducing agent solution, described above, at a predetermined ratio as well as adding a pH adjuster or ion exchanged water, as required, thereto, to produce a predetermined amount of mixed solution, the molar ratio thereof to the total amount of the mixed solution would be 0.16 M. The amounts of the trisodium citrate and the sodium tartrate were respectively adjusted such that the molar ratios thereof to the total amount of the mixed solution would be respectively 0.15 M.

[Production of Fine Copper Powder]

The reducing agent solution was poured into a reaction cell, and was agitated while maintaining the liquid temperature thereof at 50° C., a 25% ammonia solution serving as a pH adjuster was added to the solution to adjust the pH of the solution to 5.2, the reaction solution was gradually added to the solution, and ion exchanged water was further added thereto as required, to produce a predetermined amount of mixed solution. The reaction solution and the ion exchanged water, which have been previously warmed to 50° C., were added.

When the mixed solution continued to be agitated for several minutes while maintaining the liquid temperature thereof at 50° C., sediments were deposited. Accordingly, the agitation was stopped, to immediately filter, rinse, and then dry the sediments, to obtain fine powders. The pH of the mixed solution at the time point where the reaction was terminated was 3.9. Further, almost all of titanium ions in the mixed solution were tetravalent.

When the composition of the obtained fine powder was measured by ICP emission spectrometry, it was confirmed that the composition was copper having a purity of 99.9%.

When the average particle diameter of the fine copper powders was measured in the same manner as described above, it was 300 nm.

Furthermore, when particle diameter differences $G_1$ and $G_2$ were found in the foregoing manner from the results of the measurement, they were respectively 92% and 110%.

From the results, it was confirmed that the particle diameters of the fine copper powders produced in the example 3 were significantly small, the particle diameter distribution thereof was sharp, and the particle diameters thereof are uniform.

Example 4

Production of Fine Palladium-Platinum Alloy Powder

[Production of Reducing Agent Solution]

A reducing agent solution having a pH of 1 obtained by reducing 60% of tetravalent titanium ions to trivalent titanium ions, which was the same as that initially prepared in the example 1, was produced.

[Production of Reaction Solution]

Palladium Chloride, chloroplatinic acid, trisodium citrate, and sodium tartrate were dissolved in ion exchanged water, to produce a reaction solution. The amount of the palladium chloride was set such that in mixing the reaction solution with the reducing agent solution, described above, at a predetermined ratio as well as adding a pH adjuster or ion exchanged water, as required, thereto, to produce a predetermined amount of mixed solution, the molar ratio thereof to the total amount of the mixed solution would be 0.06 M. The amount of the chloroplatinic acid was adjusted such that the molar ratio thereof to the total amount of the mixed solution would be 0.06 M. The amounts of the trisodium citrate and the sodium tartrate were respectively adjusted such that the molar ratios thereof to the total amount of the mixed solution would be respectively 0.15 M.

[Production of Fine Alloy Powder]

The above-mentioned reducing agent solution was poured into a reaction cell, and was agitated while maintaining the liquid temperature thereof at 50° C., an 1N sodium hydroxide solution serving as a pH adjuster was added to the solution to adjust the pH of the solution to 5.2, the reaction solution was gradually added to the solution, and ion exchanged water was further added thereto as required, to produce a predetermined amount of mixed solution. The reaction solution and the ion exchanged water, which have been previously warmed to 50° C., were added.

When the mixed solution continued to be agitated for several minutes while maintaining the liquid temperature thereof at 50° C., sediments were deposited. Accordingly, the agitation was stopped, to immediately filter, rinse, and then dry the sediments, to obtain fine powders. The pH of the mixed solution at the time point where the reaction was terminated was 4.2. Further, almost all of titanium ions in the mixed solution were tetravalent.

When the composition of the obtained fine powder was measured by ICP emission spectrometry, it was confirmed that the composition was a 50Pd-50Pt alloy. The purity thereof was 99.9%.

When the average particle diameter of the fine alloy powders was measured in the same manner as described above, it was 8 nm.

Furthermore, when particle diameter differences $G_1$ and $G_2$ were found in the foregoing manner from the results of the measurement, they were respectively 40% and 90%.

From the results, it was confirmed that the particle diameters of the fine palladium-platinum alloy powders produced in the example 4 were significantly small, the particle diameter distribution thereof was sharp, and the particle diameters thereof were uniform.

Example 5

Production of Fine Silver Powder

[Production of Reducing Agent Solution]

A reducing agent solution having a pH of 1 obtained by reducing 60% of tetravalent titanium ions to trivalent titanium ions, which was the same as that initially prepared in the example 1, was produced.

[Production of Reaction Solution]

Silver Chloride, a 25% ammonia solution, trisodium citrate, and sodium tartrate were dissolved in ion exchanged water, to produce a reaction solution. The amount of the silver chloride was set such that in mixing the reaction solution with the reducing agent solution, described above, at a predetermined ratio as well as adding ion exchanged water thereto as required, to produce a predetermined amount of mixed solution, the molar ratio thereof to the total amount of the mixed solution would be 0.24 M. The amount of the ammonia solution was adjusted such that the molar ratio of ammonia to the total amount of the mixed solution would be 1.2 M. The amounts of the trisodium citrate and the sodium tartrate were respectively adjusted such that the molar ratios thereof to the total amount of the mixed solution would be respectively 0.15 M.

[Production of Fine Silver Powder]

The above-mentioned reducing agent solution was poured into a reaction cell, and was agitated while maintaining the liquid temperature thereof at 50° C., the reaction solution was gradually added to the solution, and ion exchanged water was further added thereto as required, to produce a predetermined amount of mixed solution. The reaction solution and the ion exchanged water, which have been previously warmed to 50° C., were added.

When the mixed solution continued to be agitated for several minutes while maintaining the liquid temperature thereof at 50° C., sediments were deposited. Accordingly, the agitation was stopped, to immediately filter, rinse, and then dry the sediments, to obtain fine powders. The pH of the mixed solution at the time point where the reaction was terminated was 6.8. Further, almost all of titanium ions in the mixed solution were tetravalent.

When the composition of the obtained fine powder was measured by ICP emission spectrometry, it was confirmed that the composition was silver having a purity of 99.9%.

When the average particle diameter of the fine silver powders was measured in the same manner as described above, it was 100 nm.

Furthermore, when particle diameter differences $G_1$ and $G_2$ were found in the foregoing manner from the results of the measurement, they were respectively 80% and 190%.

From the results, it was confirmed that the particle diameters of the fine silver powders produced in the example 5 were significantly small, the particle diameter distribution thereof was sharp, and the particle diameters thereof were uniform.

In order to examine the invention as disclosed in Japanese Patent Application No. 3018655, described above, additional tests of the example 5 of the gazette was tried in the following comparative example 1.

Comparative Example 1

Production of Fine Nickel Powder

Nickel Chloride, nitorilotrisodium triacetate, and trisodium citrate were dissolved in ion exchanged water, to produce an solution.

A 25% ammonia solution was then added to the solution to adjust the pH thereof to 10.0, and was then agitated while maintaining the liquid temperature thereof at 50° C., and titanium trichloride was poured thereinto using an injection syringe such that it does not come in contact with outward air in a nitrogen gas current, to produce a predetermined amount of mixed solution.

The molar ratio of each of components to the total amount of the mixed solution was 0.04 M of the nickel chloride, 0.1 M of the nitorilotrisodium triacetate, 0.1 M of the trisodium citrate, and 0.04 M of the titanium trichloride.

The moment the titanium trichloride was poured, a part of the solution became clouded. When the white clouding subsided after several minutes, however, segments in two colors, i.e., white segments and black segments stacked thereon were obtained.

The segments in two colors were separately extracted, and were respectively rinsed and dried, to obtain fine powders in two colors, i.e., white and black.

When the composition of the white fine powders was measured by ICP emission spectrometry, it was titanium oxide. When the amount thereof was weighed, it was confirmed that almost all of titanium ions added to the solution were deposited as titanium oxide.

On the other hand, it was confirmed that the black fine powder was nickel having a purity of 76%.

The average particle diameter of the fine nickel powders was 1 μm when it was measured in the same manner as described above.

From these results, it was confirmed that titanium trichloride could be employed only by being used up at one time in the comparative example 1, and the fine nickel powders having a small average particle diameter of not more than 400 nm could not be produced.

In order to attempt to improve the comparative example 1, the following comparative example 2 was implemented.

Comparative Example 2

Nickel Chloride, nitorilotrisodium triacetate, and trisodium citrate were dissolved in ion exchanged water, to produce an solution.

A 25% ammonia solution was then added to the solution to adjust the pH thereof to 10.5, and was then agitated while maintaining the liquid temperature thereof at 50° C., and a 20% hydrochloric acid solution of titanium trichloride was poured thereinto using an injection syringe such that it does not come in contact with outward air in a nitrogen gas current, to produce a predetermined amount of mixed solution.

The molar ratio of each of components to the total amount of the mixed solution was 0.04 M of the nickel chloride, 0.1 M of the nitorilotrisodium triacetate, 0.1 M of the trisodium citrate, and 0.04 M of the titanium trichloride.

The moment the solution of titanium trichloride was poured, a part of the solution became clouded. When the white clouding subsided after several minutes, however, segments in two colors, i.e., white segments and black segments stacked thereon were obtained. The pH of the solution was raised to 2.0.

The segments in two colors were separately extracted, and were respectively rinsed and dried, to obtain fine powders in two colors, i.e., white and black.

When the composition of the white fine powder was actually measured by ICP emission spectrometry, it was titanium oxide. When the amount thereof was weighed, it was confirmed that approximately 20% of titanium ions added to the solution were deposited as titanium oxide.

On the other hand, it was confirmed that the black fine powder was nickel having a purity of 92%.

The average particle diameter of the fine nickel powders was 0.8 μm when it was measured in the same manner as described above.

From these results, it was confirmed that titanium trichloride could be also employed only by being used up at one time even in the comparative example 2, and the fine nickel powders having a small average particle diameter of not more than 400 nm could not be produced.

The invention claimed is:

1. A method of producing a fine metal powder, characterized by comprising the steps of:

subjecting a solution containing tetravalent titanium ions having a pH of not more than 7 to cathode electrolytic treatment to reduce parts of the tetravalent titanium ions to trivalent titanium ions, to obtain a reducing agent solution containing both the trivalent titanium ions and the tetravalent titanium ions at a predetermined existing ratio; and adding a water-soluble compound of at least one type of metal element forming the fine metal powder to the reducing agent solution, followed by mixing, to reduce and deposit ions of the metal element by the reducing action at the time of oxidation of the trivalent titanium ions to the tetravalent titanium ions to grow the fine metal powder, and at the same time, to restrain the growth of the fine metal powder by the tetravalent titanium ions, thereby to obtain a fine metal powder having a article diameter corresponding to the existing ratio of the trivalent titanium ions and the tetravalent titanium ions.

2. The method of producing a fine metal powder according to claim 1, characterized in that as the solution containing the tetravalent titanium ions forming the reducing agent solution, a solution containing chlorine ions having a molar ratio which is not less than four times that of the tetravalent titanium ions is used.

3. The method of producing a fine metal powder according to claim 2, characterized in that a hydrochloric acid solution of titanium tetrachloride is used as the solution containing the tetravalent titanium ions.

4. The method of producing a fine metal powder according to claim 1, characterized in that at least one type selected from a group consisting of Ag, Au, Bi, Co, Cu, Fe, In, Ir, Mn, Mo, Ni, Pb, Pd, Pt, Re, Rh, Sn and Zn is used as the metal element forming the fine metal powder.

5. The method of producing a fine metal powder according to claim 1, wherein a concentration of the trivalent ions is less than 60%.

6. The method of producing a fine metal powder according to claim 1, characterized in that the solution containing the tetravalent titanium ions after the deposition of the fine metal powder is reproduced as the reducing agent solution by the cathode electrolytic treatment, and is repeatedly used for producing the fine metal powder.

* * * * *